US011292698B2

(12) United States Patent
Stagg

(10) Patent No.: US 11,292,698 B2
(45) Date of Patent: Apr. 5, 2022

(54) COORDINATED SAFETY INTERLOCKING SYSTEMS AND METHODS

(71) Applicant: Cattron North America, Inc., Warren, OH (US)

(72) Inventor: David Stagg, Flat Rock, NC (US)

(73) Assignee: CATTRON NORTH AMERICA, INC., Warren, OH (US)

( * ) Notice: Subject to any disclaimer, the term of this patent is extended or adjusted under 35 U.S.C. 154(b) by 441 days.

(21) Appl. No.: 15/664,069

(22) Filed: Jul. 31, 2017

(65) Prior Publication Data

US 2017/0327352 A1 Nov. 16, 2017

Related U.S. Application Data

(63) Continuation of application No. PCT/US2016/021922, filed on Mar. 11, 2016.
(Continued)

(51) Int. Cl.
*B66C 13/18* (2006.01)
*B66C 13/40* (2006.01)
(Continued)

(52) U.S. Cl.
CPC ..... *B66C 13/18* (2013.01); *B66C 13/22* (2013.01); *B66C 13/40* (2013.01); *B66C 13/44* (2013.01); *B66C 15/045* (2013.01); *B66C 17/00* (2013.01)

(58) Field of Classification Search
CPC ..... B66C 13/18; B66C 13/40; B66C 17/00; B66C 15/045; B66C 13/44; B66C 13/22;
(Continued)

(56) References Cited

U.S. PATENT DOCUMENTS 4,137,522 A * 1/1979 Stein ..... G08C 15/12 340/4.21
4,580,765 A 4/1986 Nicholson et al.
(Continued)

FOREIGN PATENT DOCUMENTS

DE 102011053014 A1 2/2013
JP 2008-126776 A 6/2008
(Continued)

OTHER PUBLICATIONS

International Search Report and Written Opinion dated Jun. 3, 2016 for PCT Application No. PCT/US2016/021922 filed Mar. 11, 2016 (published as WO 2016/153814 on Sep. 29, 2016) which is the parent application to the instant application, 15 pages.
(Continued)

*Primary Examiner* — Christian Chace
*Assistant Examiner* — Jordan S Fei
(74) *Attorney, Agent, or Firm* — Harness, Dickey & Pierce, P.L.C.; Anthony Fussner

(57) ABSTRACT

Accordingly, exemplary embodiments are disclosed of coordinated safety interlocking systems and methods of coordinating safety interlocking. In an exemplary embodiment, a system for providing coordinated safety interlocking between a plurality of machines is disclosed. The system generally includes a plurality of machine control units each configured to control at least one of the plurality of machines. The system also includes at least one operator control unit configured to define a dynamic cluster including a subset of the plurality of machine control units. The at least one operator control unit is configured to control safety interlocking between each machine control unit in the dynamic cluster. The system may be used to provide coordinated safety interlocking between various elements and/or machines, such as crane bridges and crane hoists, etc.

21 Claims, 4 Drawing Sheets

Related U.S. Application Data

(60) Provisional application No. 62/138,045, filed on Mar. 25, 2015.

(51) Int. Cl.
*B66C 13/22* (2006.01)
*B66C 13/44* (2006.01)
*B66C 15/04* (2006.01)
*B66C 17/00* (2006.01)

(58) Field of Classification Search
CPC ..... B66C 13/23; B66C 13/24; B66C 13/26; B66C 13/30; B66C 13/32; B66C 13/34; B66C 13/36; B66C 13/38; B66C 13/48; B66C 13/50; B66C 13/04; B66C 13/06; B66C 13/063; B66C 13/066; B66C 13/08; B66C 13/085; B66C 13/10; B66C 13/105; B66C 15/00; B66C 15/04; B66C 15/06; B66C 15/065
See application file for complete search history.

(56) References Cited

U.S. PATENT DOCUMENTS 6,037,901 A * 3/2000 Devier ..... E02F 9/2045 701/484
9,272,883 B2 3/2016 Behnke
9,730,204 B2 * 8/2017 Yi ..... H04L 1/1812
2004/0242249 A1 * 12/2004 Neilson ..... H04W 72/082 455/502
2010/0298968 A1 * 11/2010 King ..... B66C 19/002 700/213
2014/0251935 A1 * 9/2014 Behnke ..... B66C 13/18 212/285
2015/0284225 A1 * 10/2015 Hall ..... B66D 1/22 254/290
2016/0257534 A1 * 9/2016 Kawai ..... B66C 13/22

FOREIGN PATENT DOCUMENTS

JP 2009-263069 A 11/2009
JP 2010-235249 A 10/2010
JP 2012-071965 A 4/2012
WO WO-2004109984 A2 12/2004

OTHER PUBLICATIONS

Amudhavel J. et al: "Performance Evaluation of Dynamic Clustering of vehicles in VANET", Advanced Researcn in Computer Science Engineering & Technology, Mar. 5, 2015, pp. 1-4.
Taleb T et al: "Toward an Effective Risk-Conscious and Collaborative Vehicular Collision Avoidance System", IEEE Transactions on Vehicular Technology, vol. 59, No. 3, Mar. 1, 2010, pp. 1474-1486.
Supplementary European Search Report for EP Application No. 16769318.3 which claims priority to the same parent application as the instant application, dated Mar. 5, 2018, 6 pages.

* cited by examiner

COORDINATED SAFETY INTERLOCKING SYSTEMS AND METHODS

CROSS-REFERENCE TO RELATED APPLICATIONS

This application is a continuation of PCT International Application No. PCT/US2016/021922 filed Mar. 11, 2016 (published as WO 2016/153814 on Sep. 29, 2016, which, in turn, claims the benefit of and priority to U.S. provisional application No. 62/138,045 filed Mar. 25, 2015. The entire disclosures of the above applications are incorporated herein by reference.

FIELD

The present disclosure generally relates to coordinated safety interlocking systems and methods of coordinating safety interlocking.

BACKGROUND

This section provides background information related to the present disclosure which is not necessarily prior art.

Machines (e.g., crane hoists, bridges, etc.) may require a safety interlock between various elements so that if one element stops, the other elements also stop. For example, a load may be carried between two cranes operating together to move a large item from one point to another. The load may be suspended from a hoist on each crane with two crane bridges carrying the hoist units. When the crane bridges move, if one bridge stops the other should stop to avoid dropping the load.

SUMMARY

This section provides a general summary of the disclosure, and is not a comprehensive disclosure of its full scope or all of its features.

According to various aspects, exemplary embodiments are disclosed of coordinated safety interlocking systems and methods of coordinating safety interlocking. In an exemplary embodiment, a system for providing coordinated safety interlocking between a plurality of machines is disclosed. The system generally includes a plurality of machine control units each configured to control at least one of the plurality of machines. The system also includes at least one operator control unit configured to define a dynamic cluster including a subset of the plurality of machine control units. The at least one operator control unit is configured to control safety interlocking between each machine control unit in the dynamic cluster.

The system may be used to provide coordinated safety interlocking between various elements and/or machines, such as crane bridges and crane hoists, etc. For example, the system may be used to provide coordinated safety interlocking for a plurality of crane bridges and a plurality of crane hoists each coupled to a corresponding one of the crane bridges. In this example, each of the plurality of machine control units may be coupled to, configured to control, and/or be corresponding to a corresponding one of the crane bridges or a corresponding one of the crane hoists.

An exemplary embodiment of a coordinated safety interlocking system generally includes a plurality of crane bridges and a plurality of crane hoists. Each crane hoist is coupled to a corresponding one of the crane bridges. The system also includes a plurality of machine control units. Each machine control unit is coupled to a corresponding one of the crane bridges or a corresponding one of the crane hoists and configured to control the corresponding crane bridge or corresponding crane hoist. The system further includes at least one operator control unit configured to define a dynamic cluster including a subset of the plurality of machine control units, and to control safety interlocking between each machine control unit in the dynamic cluster.

In another exemplary embodiment, a method of coordinating safety interlocking in a system is disclosed. The method generally includes defining, at at least one operator control unit, a dynamic cluster of machine control units by selecting a subset of a plurality of machine control units. The method also includes receiving, at the at least one operator control unit, an operation status from each machine control unit in the dynamic cluster. The method further includes transmitting, from the at least one operator control unit, a safety interlocking control message to each machine control unit in the dynamic cluster to control safety interlocking between the machine control units. The safety interlocking control message includes an operation status for each machine control unit in the dynamic cluster.

The method may be used for coordinating safety interlocking between various elements and/or machines, such as crane bridges and crane hoists, etc. For example, the system may include a plurality of crane bridges and a plurality of crane hoists each coupled to a corresponding one of the crane bridges. In this example, each of the plurality of machine control units may be coupled to, configured to control, and/or be corresponding to a corresponding one of the crane bridges or a corresponding one of the crane hoists.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
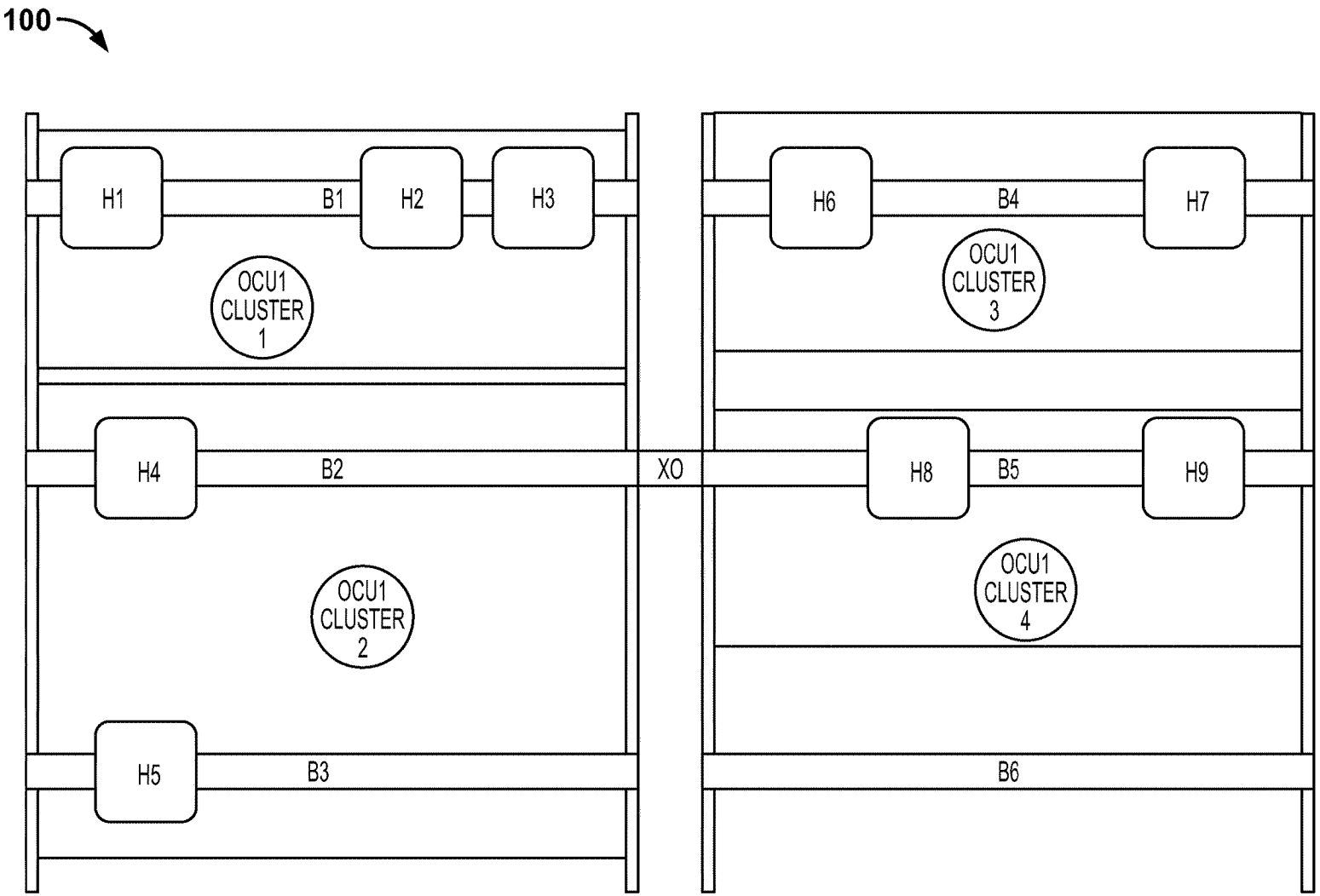
FIG. 1 is a block diagram of an example coordinated safety interlocking system according to some aspects of the present disclosure.

Example embodiments will now be described more fully with reference to the accompanying drawings.

The inventor has recognized that machines (e.g., crane hoists, crane bridges, etc.) may require a safety interlock between various elements so that if one element stops, the other elements also stop. For example, a load may be carried between two cranes operating together to move a large item from one point to another. The load may be suspended from a hoist on each crane with two crane bridges carrying the hoist units. When the crane bridges move, if one bridge stops the other bridge should stop to avoid dropping the load.

The inventor has also recognized that this safety interlocking may be carried out by adding on additional equipment that provides machine interlocking. It is possible that this interlocking exists in a remote control system where the equipment is relatively static such as, for example, a crane bay consisting of two cranes each with a hoist unit. There may be two operator control units (OCUs), one associated with each crane. When the two cranes operate in tandem, one of the OCUs could control both cranes, and the interlocking would be achieved by two machine control units (MCUs) communicating to each other. The machine control units may be part of the remote control system, may be attached to the machines (e.g., cranes, etc.), may be linked wirelessly to the operator control units, etc.

The inventor has further recognized that this may not allow for a dynamic cluster where one of a plurality (e.g., one of many, etc.) of operator control units may control multiple ones (e.g., several, etc.) of a plurality (e.g., of a large number, etc.) of machine control units. In this case, the coordinating item may be the operator control unit. The operator control unit may request and receive messages from the specific machine control units that have been requested to join the cluster that the operator control unit is controlling. An operator control unit may implement one or more unique capabilities to achieve this level of control.

According to some aspects of the present disclosure, sub-addressing may be used to securely group and control a dynamic cluster of machines with remote control. For example, the operator control unit may use sub-addressing to define a dynamic cluster of machine control units by selecting a subset of machine control units. The selection of the dynamic cluster may be implemented using sub-addressing where a master address is used for all machine control units in the dynamic cluster and a different address extension is used to uniquely identify each individual machine control unit in the dynamic cluster.

An extended dynamic time domain multiple access (ED-TDMA) scheme may be used to enable efficient sharing of a radio frequency, and allow all elements of one cluster (e.g., operating amongst many clusters, etc.) to be substantially simultaneously addressed. For example, the ED-TDMA sharing scheme may separate transmissions into multiple time slots for messages to be transmitted on a same radio frequency between an operator control unit and the machine control units in the dynamic cluster. The ED-TDMA scheme may include extended slots for both OCU transmissions and MCU reply transmissions.

Coordination of a cluster by the OCU may make it possible to enable a dynamic (e.g., changeable, etc.) group of multiple machine control units from many MCUs. For example, the operator control unit may define a first dynamic cluster by selecting a first subset of machine control units. The OCU can then change to a second dynamic cluster by selecting a different subset of machine control units. The second dynamic cluster may include some of the same machine control units as the first dynamic cluster, none of the same MCUs as the first dynamic cluster, all of the same MCUs as the first dynamic cluster plus additional MCUs, etc.

Coordinated talkback from machine control units may enable interlocking of safety critical functions between MCUs. For example, the operator control unit may receive safety status information from each machine control unit in its cluster. The safety status may indicate whether equipment under control of an MCU is moving properly, whether the equipment has failed, whether the MCU has a strong communication signal to the OCU, what type of machine is under control of the MCU, etc. The operator control unit can then transmit a message to all machine control units in the cluster to indicate safety status of all MCUs in the cluster so that each MCU can determine whether to stop, in the event a safety failure has occurred. For example, if the operator control unit receives an indication that one of the machine control units in the cluster has failed (e.g., stopped moving, etc.), he OCU may transmit this information to all other machine control units in the cluster so the other MCUs can stop their movement.

The operator control unit may securely address each machine control unit. Some example embodiments may have sub-addressing that includes a master address (e.g., 24 bit master address, etc.) and address extensions (e.g., one for each machine control unit under the control of the OCU, etc.). In some embodiments, the address extension may include one or more multi-bit fields, where each multi-bit field corresponds to a machine control unit. In other embodiments, the address extension may include a bit-wise field, where each bit (e.g., single-bit, etc.) corresponds to a machine control unit. Multiple ON bits may indicate multiple ON state machine control units. Each of the machine control units may have the same master address plus one or more of the address extensions. If a machine control unit finds a master address match and an address extension match in a transmission from an operator control unit, the MCU is under control of the OCU.

An ED-TDMA scheme may be a radio frequency (RF) scheme and may operate in an ultra-high frequency (UHF) band that uses relatively slow data rates, which may make it difficult to update command functions for the machine control units and safely interlock the machine safety interlocks in a timely manner.

Some embodiments of the present disclosure may define extended slots. For example, the extended slots may include more than one slot (e.g., two slots, three slots, four slots, etc.) to accommodate an operator control unit transmission and one or more MCU reply transmissions (e.g., one MCU reply transmission, two MCU reply transmissions, three MCU reply transmissions, etc.). In other embodiments, an OCU transmission may occupy more or less slots, an MCU reply transmission may occupy more or less slots, the OCU transmission and MCU reply transmission may occupy only part of a slot, etc.

Operator control units may use background scanning to identify free slots in a defined telegram frame. For example, the OCUs may scan telegram frames to detect slots that are not being used for control signal transmissions. This scanning may occur during background operation of the OCU so it does not interfere with normal OCU operation. The operator control unit may then operate within the identified free slots. For example, the operator control unit may send and/or receive transmissions to and/or from machine control units occupying previously identified free slots.

Operator control units may control a number of talkback slots used by machine control units by implementing a talkback request control field. For example, operator control units may limit the number of talkback slots that can be used by machine control units to send reply transmissions to the OCU. This operator control unit may control the number of talkback slots to provide timely safety interlocking between the machine control units, allow each machine control unit to send reply transmissions in a timely manner, keep sufficient slots available for other control operation data to be transmitted, etc. The talkback request control field may include one or more bits that indicate to the machine control units when the MCUs may transmit reply (e.g., talkback, etc.) messages, which MCUs are allowed to send reply messages, etc.

One operator control unit may control and request talkback sequentially from many machine control units. For example, the OCU may send transmissions that indicate when MCUs are allowed to send talkback messages to the OCU, which time slots each MCU is allowed to use, etc. The operator control unit may address each machine control unit separately using a different sub-address. The talkback messages may be sent sequentially from the machine control units such that each machine control unit may send a talkback message after another one of the machine control units is finished sending its own talkback message.

An operator control unit may control dynamic clusters of machine control units, such that the OCU can change which MCUs are under its control and belong to its cluster. Thus, the machine control units included in the dynamic cluster can change over time as the OCU adds new MCUs to the cluster, removes MCUs from the cluster, defines new clusters, etc.

In some embodiments, the operator control unit can receive safety states from each machine control unit in the cluster. The OCU can then analyze these safety states and transmit the safety state information back out to all machine control units that are addressed in the cluster. The safety state information may be transmitted in a safety state data field that is incorporated into a telegram (e.g., field, frame, slot, etc.) that is transmitted by the operator control unit. The safety state may include an operation state value (e.g., Go/NoGo, whether the machine controlled by the MCU is functioning properly, etc.). The safety state may include a communication health measurement, which may be indicative of whether the machine control unit has a reliable connection to the OCU such that the transmissions will not be dropped soon, give bad information, lost packets and data, etc. The safety state may include a machine type bit, value, etc. so that different responses may be taken by the machine control units when a failure is reported.

For example, an operator control unit may send a command telegram to the machine control units within its dynamic cluster. The command telegram may include a sequential talkback request for data from each machine control unit, which may be based on time sharing criteria. When requested, the machine control unit may return data to the OCU. The data may include a RUN/STOP state based on a digital input from a local motor drive monitor, and a TYPE of function the machine control unit is controlling (e.g., hoist, bridge, etc.). The operator control unit may receive this information and combine the received information with other information regarding whether the OCU is able to receive the MCU talkback message, whether only other machines of the same type should be stopped or if all machines should be stopped, etc. The OCU then embeds a RUN/STOP bit relating to each MCU being controlled in the OCU command message. Each machine control unit in the cluster then receives this message to determine whether the machine control unit should run or stop operation of the machine it is controlling.

As an example, two electric overhead traveling (EOT) cranes may be operating in tandem and one hoist may fail. The safety sequence may require the other hoist to stop, but may allow the two crane bridges to continue moving without a hazardous situation arising.

In some embodiments, machines that are the same type may be required to stop when another machine of the same type fails, but machines of different types may be allowed to continue operating. For example, if a hoist fails, continued movement of another hoist may cause the load to drop as the load becomes unbalanced. However, the bridges connected to each hoist may continue to move because the movement of the bridges will not disturb the balance of the load even though one of the hoists has failed.

In some embodiments, the operator control units control the machine control units in the cluster (e.g., send control signals, provide instructions for movement of the machines coupled to the MCUs, etc.). The OCUs may control sequencing, timing, etc. of the machine control unit talkback requests. Thus the operator control units may control safety interlocking of the machines being controlled by the machine control units.

Some embodiments described herein may not require any secondary system, additional hardware, etc. to implement coordinated safety interlocking, because an operator control unit is capable of implementing safety interlocking between machine control units in a dynamic cluster.

Some embodiments described herein may provide one or more (or none) advantages, including providing an ability to define a dynamic (e.g., changing, etc.) set of operator control units and machine control units, easy configuration by changing machine control unit sub-addressing on an operator control unit, etc. Some embodiments may be used in large installations including aircraft manufacturing facilities, etc. where many (e.g., hundreds, etc.) of machine control units corresponding to individual hoists and bridges may be grouped into a cluster and controlled by one of multiple (e.g., fifty, etc.) operator control units.

Referring now to the figures, FIG. 1 illustrates an example coordinated safety interlocking system 100 embodying one or more aspects of the present disclosure. As shown in FIG. 1, there are six crane bridges B1-B6, which travel along rails. Each bridge includes one or more (or none) crane hoists H1-H9. For example, bridge B1 includes hoists H1, H2 and H3; bridge B2 includes hoist H4; bridge B3 includes hoist H5; bridge B4 includes hoists H6 and H7; bridge B5 includes hoists H8 and H9; and bridge B6 does not include any hoists.

The crane hoists may be free to move across from bridge to bridge via cross over section XO. For example, hoist H4 may move from bridge B2, across or along cross over section XO, and onto bridge B5. As another example, bridge B6 may move up to cross over section XO such that hoist H4 can move across to bridge B6. Therefore, each hoist may be able to associate with any bridge.

Each bridge and hoist have a connected machine control unit (not shown in FIG. 1), and each can be controlled by an operator control unit. A number of operator control units are shown operating within a facility in FIG. 1. Each OCU is able to select a number of hoists and bridges to create a cluster. As shown in FIG. 1, OCU1 CLUSTER 1 controls bridge B1 and hoists H1-H3. OCU1 CLUSTER 3 controls bridge B4 and hoists H6 and H7. An operator control unit may be capable of controlling multiple bridges. For example, OCU1 CLUSTER 2 includes bridge B2 and its hoist H4 as well as bridge B3 and its hoist H5.

If any hoist in a cluster stops, the other hoists in the cluster should also stop. If any bridge in a cluster stops, the other bridges in the cluster should also stop. To achieve this, each hoist and bridge may send talkback messages to the OCU including a current status of the hoist or bridge. Thus, the operator control unit is the common factor and coordinating device for these dynamic clusters.

All devices in a cluster may use a same frequency by using TDMA, but it would be possible to have one frequency for operator control unit transmission and a second frequency for the machine control units to talkback, although the use of TDMA would still be used for the MCUs. TDMA makes it possible for multiple transmissions to share the same frequency. Some embodiments may have a lower frequency (e.g., 450 MHz, etc.) and may use TDMA. Other embodiments may use other frequencies (e.g., 2.4 GHz, Wi-Fi frequencies, etc.).

Any suitable methods described herein may be implemented in the system 100 of FIG. 1 to provide coordinated safety interlocking between multiple crane bridges and crane hoists via an operator control unit in communication with multiple machine control units.

Figure 2:
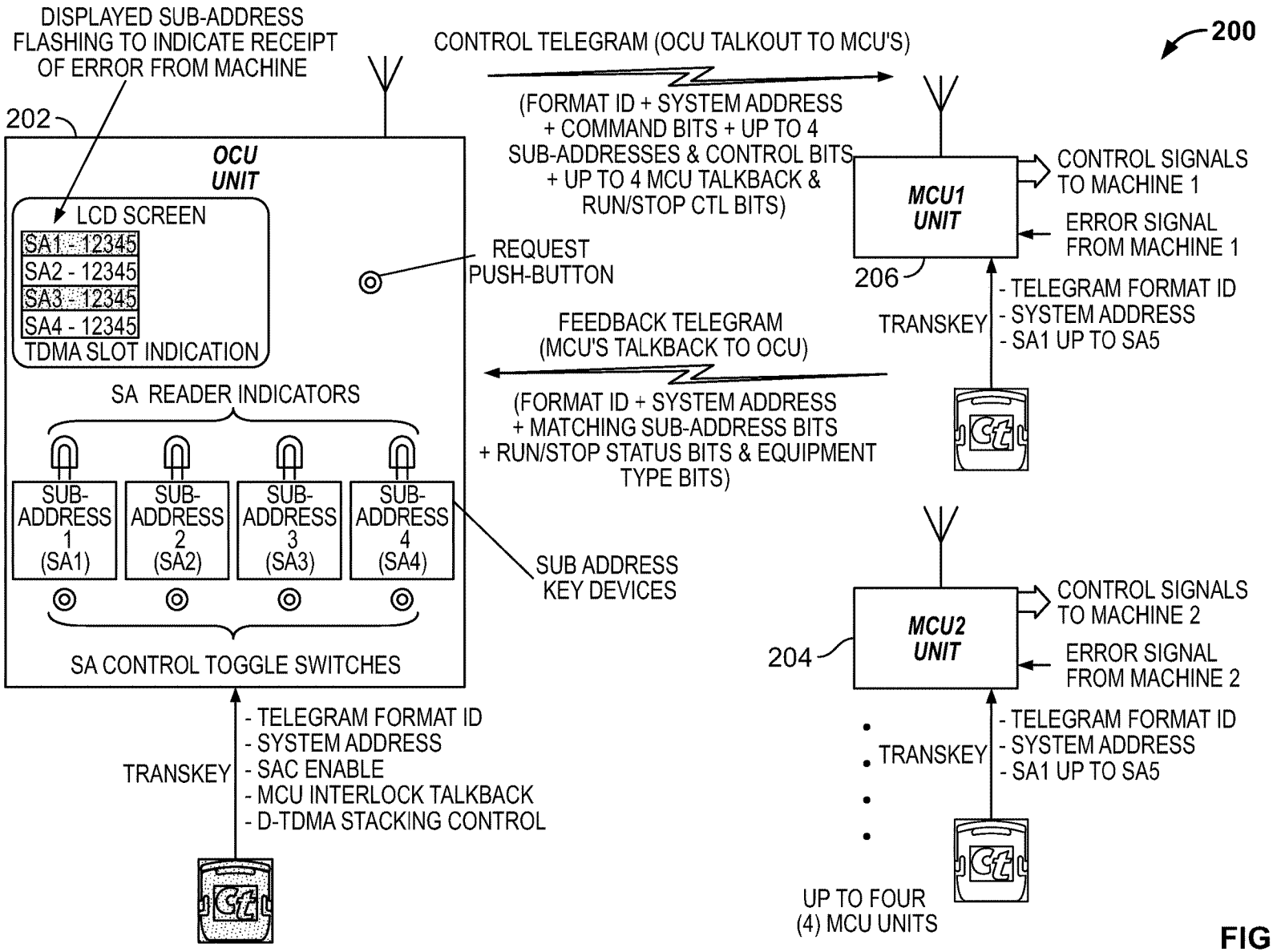
FIG. 2 is a block diagram and data flow of another example coordinated safety interlocking system.

FIG. 2 illustrates another example system 200 having an operator control unit 202 and two machine control units 204 and 206. The OCU 202 includes an LCD screen for displaying sub-addresses (SAs) of MCUs 204 and 206, TDMA slot indication, etc. The OCU 202 also includes SA Reader indicators and SA Control Toggle Switches.

As shown in FIG. 2, the OCU 202 may send a control telegram to the MCUs 204 and 206, which may include a Format ID, System Address, Command Bits, multiple sub-addresses, multiple MCU talkback & Run/Stop Control Bits, etc. Each machine control unit 204 and 206 may be configured to send a feedback telegram to the operator control unit 202, which may include a Format ID, System Address, Matching Sub-Address Bits, Run/Stop Status bits & Equipment Type bits, etc.

Each machine control unit 204 and 206 may be configured to send control signals to a respective machine and to receive error signals from the machine. Although FIG. 2 illustrates two machine control units, other embodiments may include more or less than two machine control units.

Figure 3:
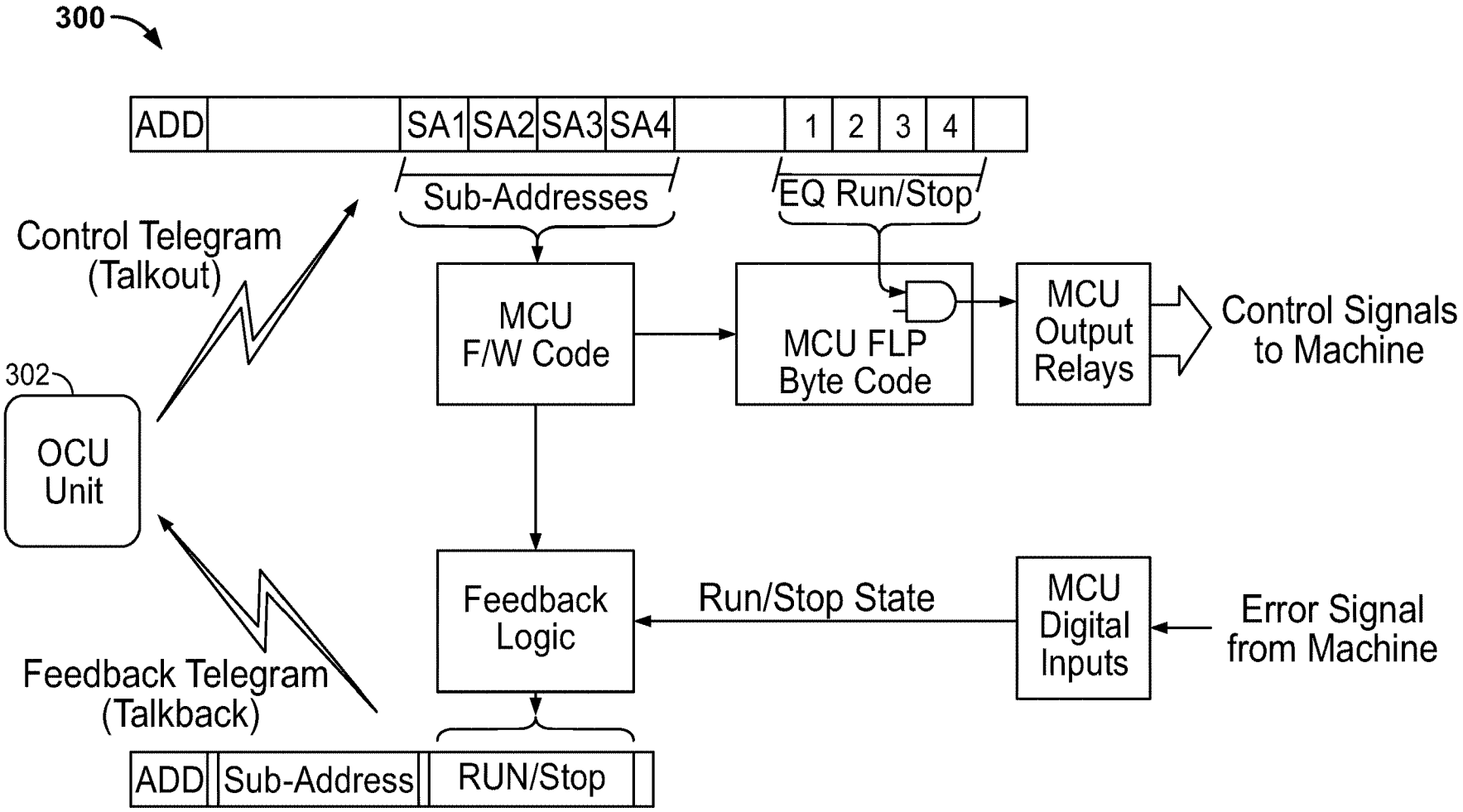
FIGS. 3 and 4 are block diagrams of example transmission message protocols of a coordinated safety interlocking system.

FIG. 3 illustrates a protocol 300 for transmission of messages between an operator control unit 302 and a machine control unit. The control telegrams (e.g., talkout, etc.) from the operator control unit 302 include sub-addresses SA1-SA4 and EQ Run/Stop bits. The MCU reads the sub-addresses to determine if the MCU is being addressed and reads the corresponding Run/Stop bit. The MCU then sends an appropriate control signal to the machine under control. The MCU also reads an error signal from the machine and transmits an appropriate Run/Stop signal to the OCU Unit 302 in a feedback telegram (e.g., talkback, etc.).

Figure 4:
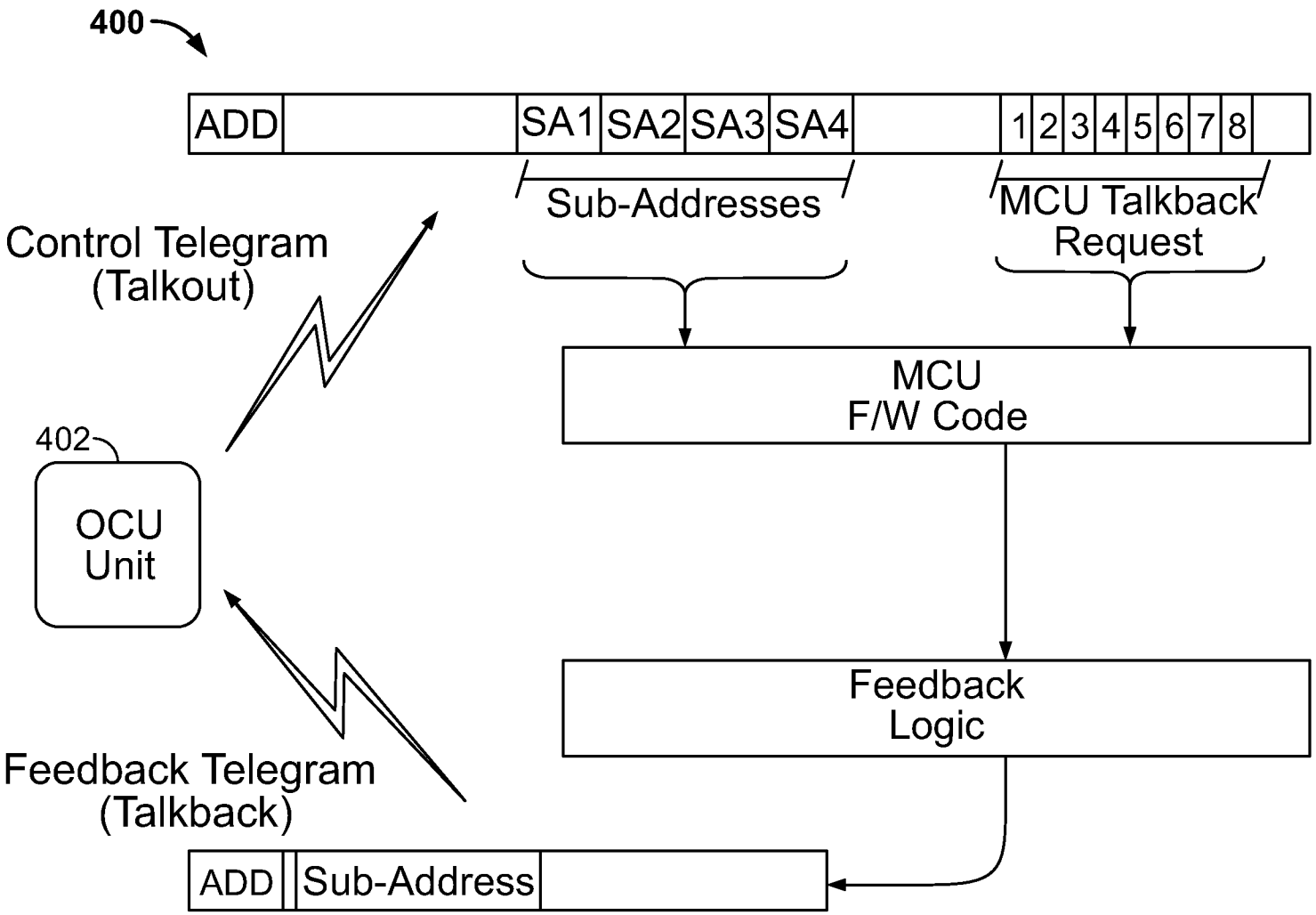

FIG. 4 illustrates another example protocol 400 for transmission of messages between an operator control unit 402 and a machine control unit. FIG. 4 illustrates a control telegram including sub-addresses SA1-SA4 and MCU talkback requests 1-8. The MCU reads the sub-addresses and MCU talkback requests to determine if the MCU should send a feedback telegram to the OCU, what slot the MCU should use to send the feedback telegram, etc.

Accordingly, exemplary embodiments are disclosed of coordinated safety interlocking systems and methods of coordinating safety interlocking. In an exemplary embodiment, a system for providing coordinated safety interlocking between a plurality of machines is disclosed. The system generally includes a plurality of machine control units each configured to control at least one of the plurality of machines. The system also includes at least one operator control unit configured to define a dynamic cluster including a subset of the plurality of machine control units. The at least one operator control unit is configured to control safety interlocking between each machine control unit in the dynamic cluster.

The system may be used to provide coordinated safety interlocking between various elements and/or machines, such as crane bridges and crane hoists, etc. For example, the system may be used to provide coordinated safety interlocking for a plurality of crane bridges and a plurality of crane hoists each coupled to a corresponding one of the crane bridges. In this example, each of the plurality of machine control units may be coupled to, configured to control, and/or be corresponding to a corresponding one of the crane bridges or a corresponding one of the crane hoists.

The system may include multiple operator control units each configured to define a respective dynamic cluster that corresponds to one OCU and includes a subset of the MCUs that correspond to the OCU. The operator control unit may be configured to control safety interlocking between the corresponding machine control units in its dynamic cluster. Each operator control unit may be configured to request and receive messages from each corresponding MCU in its respective dynamic cluster.

The operator control unit may be configured to use sub-addressing to define the dynamic cluster of machine control units, as described herein. The OCU may be configured to use an ED-TDMA scheme to substantially simultaneously address the MCUs in its cluster. The OCU may define extended slots that are at least three transmissions wide to accommodate an operator control unit transmission and at least one machine control unit reply transmission. The OCU may be configured to scan to identify free slots in a defined telegram frame and transmit messages in the identified free slots, implement a talkback request control field to control the number of talkback slots used by the machine control units in the dynamic cluster, control and request talkback messages sequentially from a plurality of machine control units in the dynamic cluster, etc.

An operator control unit may be configured to change the dynamic cluster by adding and removing machine control units from the dynamic cluster to control safety interlocking between different subsets of the machine control units at different times. Each machine control unit in the dynamic cluster may be configured to transmit a talkback message to the operator control unit indicative of a safety status of the machine control unit. The operator control unit may be configured to analyze the safety status of each machine control unit and transmit the safety statuses back to all machine control units in the dynamic cluster via a safety state data field. Each safety status may include an operation state value, a communication health measurement value, and a machine type bit value. Each machine control unit is configured to stop operation when a failure is reported.

When the system is used for providing coordinated safety interlocking between a plurality of crane bridges and crane hoists, an operator control unit may be configured to stop operation of all crane hoists in the dynamic cluster if any crane hoists in the dynamic cluster stop moving, and may be configured to stop operation of all crane bridges in the dynamic cluster if any crane bridges in the dynamic cluster stop moving.

In some embodiments, an operator control unit may be configured to transmit messages on a first frequency and each of the machine control units in the dynamic cluster may be configured to transmit talkback messages on a second frequency. In other embodiments, the operator control unit and each of the machine control units in the dynamic cluster are configured to transmit messages on the same frequency (e.g., about 450 MHz, about 2.4 GHz, etc.).

According to another example embodiment, a method of coordinating safety interlocking in a system. The method may include defining, at at least one operator control unit, a dynamic cluster of machine control units by selecting a subset of a plurality of machine control units. The method may also include receiving, at the at least one operator control unit, an operation status from each machine control unit in the dynamic cluster. The method may further include transmitting, from the at least one operator control unit, a safety interlocking control message to each machine control unit in the dynamic cluster to control safety interlocking between the machine control units. The safety interlocking control message may include an operation status for each machine control unit in the dynamic cluster.

The method may include defining, at the at least one operator control unit, multiple clusters of machine control units by selecting different subsets of the plurality of machine control units, and controlling, from the operator control unit, safety interlocking of the different dynamic clusters of machine control units.

The method may be used for coordinating safety interlocking between various elements and/or machines, such as crane bridges and crane hoists, etc. For example, the system may include a plurality of crane bridges and a plurality of crane hoists each coupled to a corresponding one of the crane bridges. In this example, each of the plurality of machine control units may be coupled to, configured to control, and/or be corresponding to a corresponding one of the crane bridges or a corresponding one of the crane hoists. Continuing with this example, the method may include stopping operation of each crane bridge in the dynamic cluster if any other crane bridges in the dynamic cluster have stopped moving, and stopping operation of each crane hoist in the dynamic cluster if any other crane hoists in the dynamic cluster have stopped moving.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for providing coordinated safety interlocking between a plurality of machines, the system comprising:

a plurality of machine control units each configured to control at least one of the plurality of machines; and at least one operator control unit configured to define a dynamic cluster including a subset of the plurality of machine control units and to control safety interlocking between each machine control unit in the dynamic cluster by, in response to receiving an indication that one of the machine control units in the dynamic cluster has failed, transmitting an instruction to each machine control unit in the dynamic cluster to stop movement of the machines controlled by the machine control units in the dynamic cluster;

wherein the at least one operator control unit is configured to change the dynamic cluster by adding and removing machine control units from the dynamic cluster to control safety interlocking between different subsets of the machine control units at different times, by defining a first dynamic cluster by selecting a first subset of machine control units and changing to a second dynamic cluster by selecting a second subset of machine control units, the first subset of the first dynamic cluster includes multiple machine control units, the second subset of the second dynamic cluster includes multiple machine control units, and the first subset of multiple machine control units in the first dynamic cluster is different than the second subset of multiple machine control units in the second dynamic clusters;

wherein:

the plurality of machine control units are each configured to control one of a plurality of crane bridges, and a plurality of crane hoists, each crane hoist coupled to a corresponding one of the crane bridges;

each of the plurality of machine control units is coupled to a corresponding one of the crane bridges or a corresponding one of the crane hoists and configured to control the corresponding crane bridge or corresponding crane hoist;

the operator control unit is configured to stop operation of all crane hoists in the dynamic cluster if any crane hoists in the dynamic cluster stop moving; and the operator control unit is configured to stop operation of all crane bridges in the dynamic cluster if any crane bridges in the dynamic cluster stop moving.

2. The system of claim 1, wherein the second dynamic cluster includes none of the same machine control units as the first dynamic cluster.

3. The system of claim 2, wherein:

each machine control unit in the dynamic cluster is configured to transmit a talkback message to the operator control unit indicative of a safety status of the machine control unit; and each machine control unit in the dynamic cluster is configured to stop operation when a failure of a machine control unit in the dynamic cluster is reported.

4. The system of claim 1, wherein:

the at least one operator control unit includes a plurality of operator control units; and each operator control unit is configured to define a respective dynamic cluster corresponding to the operator control unit that includes a corresponding subset of the plurality of machine control units, the operator control unit configured to control safety interlocking between each corresponding machine control unit in the respective dynamic cluster.

5. The system of claim 4, wherein each of the operator control units are configured to request and receive messages from each corresponding machine control unit in the respective dynamic cluster.

6. The system of claim 1, wherein:

the at least one operator control unit is configured to use sub-addressing to define the dynamic cluster of machine control units; and the at least one operator control unit is configured to use an extended dynamic time domain multiple access scheme to substantially simultaneously address the machine control units in the dynamic cluster.

7. The system of claim 6, wherein the at least one operator control unit is configured to define extended slots that are at least two transmissions wide to accommodate an operator control unit transmission and at least one machine control unit reply transmission.

8. The system of claim 6, wherein the at least one operator control unit is configured to scan to identify free slots in a defined telegram frame and transmit messages in the identified free slots.

9. The system of claim 6, wherein the at least one operator control unit is configured to implement a talkback request control field to control a number of talkback slots used by the machine control units in the dynamic cluster.

10. The system of claim 6, wherein the at least one operator control unit is configured to control and request talkback messages sequentially from a plurality of machine control units in the dynamic cluster.

11. The system of claim 1, wherein each machine control unit in the dynamic cluster is configured to transmit a talkback message to the operator control unit indicative of a safety status of the machine control unit.

12. The system of claim 11, wherein the operator control unit is configured to analyze the safety status of each machine control unit and transmit the safety statuses back to all machine control units in the dynamic cluster via a safety state data field.

13. The system of claim 12, wherein each safety status includes an operation state value, a communication health measurement value, and a machine type bit value.

14. The system of claim 13, wherein each machine control unit is configured to stop operation when a failure is reported.

15. The system of claim 1, wherein the at least one operator control unit is configured to transmit messages on a first frequency and each of the machine control units in the dynamic cluster are configured to transmit talkback messages on a second frequency.

16. The system of claim 1, wherein the operator control unit and each of the machine control units in the dynamic cluster are configured to transmit messages on the same frequency.

17. The system of claim 16, wherein the frequency is 450 MHz.

18. A method of coordinating safety interlocking between a plurality of machines in a system, the method comprising:

defining, by at least one operator control unit, a dynamic cluster of machine control units by selecting a subset of a plurality of machine control units each configured to control at least one of the plurality of machines, wherein the at least one operator control unit defines the dynamic cluster by using a master address for all machine control units in the dynamic cluster and a different address extension to uniquely identify each individual machine control unit in the dynamic cluster, and the at least one operator control unit uses an extended dynamic time domain multiple access scheme to substantially simultaneously address the machine control units in the dynamic cluster;

receiving, at the at least one operator control unit, an operation status from each machine control unit in the dynamic cluster;

transmitting, from the at least one operator control unit, a safety interlocking control message to each machine control unit in the dynamic cluster, the safety interlocking control message including an operation status for each machine control unit in the dynamic cluster; and changing, by the at least one operator control unit, the dynamic cluster by adding and removing machine control units from the dynamic cluster to control safety interlocking between different subsets of the machine control units at different times, by defining a first dynamic cluster by selecting a first subset of machine control units and changing to a second dynamic cluster by selecting a second subset of machine control units, wherein the first subset of the first dynamic cluster includes multiple machine control units, the second subset of the second dynamic cluster includes multiple machine control units, and the first subset of multiple machine control units in the first dynamic cluster is different than the second subset of multiple machine control units in the second dynamic cluster;

wherein each of the plurality of machine control units is configured to control a corresponding one of a plurality of crane bridges or a corresponding one of a plurality of crane hoists; and wherein the method further comprises:

stopping operation of each crane bridge in the dynamic cluster if any other crane bridges in the dynamic cluster have stopped moving; and stopping operation of each crane hoist in the dynamic cluster if any other crane hoists in the dynamic cluster have stopped moving.

19. The method of claim 18, wherein the second dynamic cluster includes none of the same machine control units as the first dynamic cluster.

20. The method of claim 19, wherein the method further comprises controlling, from the at least one operator control unit, safety interlocking of the second dynamic cluster of machine control units.

21. The method of claim 18, further comprising controlling, from the at least one operator control unit, safety interlocking of the second dynamic cluster of machine control units.

* * * * *